US006401405B1

(12) United States Patent
Hicks

(10) Patent No.: US 6,401,405 B1
(45) Date of Patent: Jun. 11, 2002

(54) MONOLITHIC PRE-FORMED HEADER AND ARCHED OPENING FOR STANDARD CONCRETE BLOCK AND WOOD FRAME BUILDING CONSTRUCTION

(76) Inventor: C. Lorin Hicks, 310 W. Magnolia St., Leesburg, FL (US) 34748

( * ) Notice: Subject to any disclaimer, the term of this patent is extended or adjusted under 35 U.S.C. 154(b) by 0 days.

(21) Appl. No.: 09/487,523

(22) Filed: Jan. 19, 2000

Related U.S. Application Data

(60) Provisional application No. 60/116,465, filed on Jan. 20, 1999.

(51) Int. Cl.[7] ..... E04B 1/32

(52) U.S. Cl. ..... 52/88; 52/86; 52/211; 52/745.07

(58) Field of Search ..... 52/86, 88, 89, 52/211, 213, 210, 745.07, 311.2

(56) References Cited

U.S. PATENT DOCUMENTS 1,619,631 A * 3/1927 Pataswik ..... 52/204.62
2,005,572 A * 6/1935 Vass ..... 52/85
3,511,006 A * 5/1970 Medow ..... 52/301
4,301,632 A * 11/1981 Wagner ..... 52/211
4,400,917 A * 8/1983 Massaro et al. ..... 52/86
5,444,948 A * 8/1995 Trapp ..... 52/127.2
5,526,618 A * 6/1996 Thomas ..... 52/211

* cited by examiner

*Primary Examiner*—Carl D. Friedman
*Assistant Examiner*—Jennifer I. Thissell
(74) *Attorney, Agent, or Firm*—Dorothy S. Morse

(57) ABSTRACT

A method and system for use in forming arched openings in both concrete block and wood frame building construction. In block construction the present invention provides for the use of monolithic plant pre-cast and reinforced concrete header and arched filler combination units that is load-bearing, and in wood frame construction the present invention provides for the use of non-load-bearing pre-formed arch-filling members that could be made from recycled plastic attached to or including a lintel for overlaying the surrounding wall frame. Use of the present invention would eliminate the need for labor-intensive post and beam type headers with a site-built wooden arch and thereby reduce the on-site costs currently associated with site installation of windows and doors having an arched upper perimeter. The materials from which the present invention is made would determine its load-bearing capacity. In addition to having a labor saving advantage, the method of the present invention is also costs-efficient by eliminating material waste that results from materials being incorrectly measured and cut on a job site. Applications may include, but are not limited to, use in more rapidly, cost-efficiently, and easily forming openings for windows and doors having an arched upper perimeter in both residential and commercial construction.

20 Claims, 3 Drawing Sheets

MONOLITHIC PRE-FORMED HEADER AND ARCHED OPENING FOR STANDARD CONCRETE BLOCK AND WOOD FRAME BUILDING CONSTRUCTION

This patent application is for the invention disclosure in provisional patent application No. 60/116,465, filed by the same inventor on Jan. 20, 1999.

BACKGROUND

1. Field of Invention

The present invention relates to materials and methods used in building construction to make arched-shaped openings, specifically to a method and system for use in forming arched openings in both concrete block and wood frame building construction. The materials from which it was made would determine its load bearing capacity. Applications may include, but are not limited to, use in more rapidly and easily forming a window opening with an arched upper perimeter in both residential and commercial construction.

2. Description of Prior Art

In recent construction of both residential and commercial buildings, one can see the increasing popularity of building designs having windows and doors with an arched upper perimeter. They add an aesthetically pleasing and architecturally sophisticated look to a building. However, to make the openings for installation of such windows and doors. plywood and 2×4's are commonly used to form the concavely configured upper perimeter and such structures are commonly built on site. The disadvantage of this prior art method is that it is time consuming. A framer would have to refer to the radius of curvature of the window or door intended for installation and accordingly measure and cut several structural 2×4 pieces of wood having incremental differences in length. Once a standard rectangular window or door frame was constructed around a wall opening of sufficient height to accommodate installation of the intended arched window or door. the shortest 2×4 pieces of wood would then be attached centrally to the upper perimeter of the standard frame so as to downwardly and perpendicularly depend therefrom. Thereafter, in succession the incrementally longer 2×4 pieces of wood would be placed at spaced-apart distances from the shortest 2×4 piece or pieces of wood and also attached to the standard frame so as to also downwardly and perpendicularly depend therefrom. Referring again to the radius of curvature of the window or door intended for installation, the framer would then measure and cut two pieces of plywood each with one concavely arcuate perimeter edge having a radius of curvature identical to that of the window or door intended for installation within the wall opening. The cut plywood pieces would then each he oriented with its arcuate perimeter edge facing the center of the wall opening and secured within the inside perimeter of the standard frame to each of the 2×4 pieces attached to the upper perimeter of the standard frame. When the above cutting, measuring and attaching steps are repeated for the installation of even a few arched windows and doors used in a building design, the total time required to perform the extra framing steps for the arched windows and doors becomes significant.

The method of the present invention contemplates the use of monolithic pre-cast arched concrete headers in block construction. as well as the use of pre-formed arches in wood frame construction that could be made from recycled plastic attached to or including a lintel. Installation time for each pre-formed arch is estimated to be as little as five minutes. Use of the method disclosed in the present invention would eliminate the need for post and beam type headers with a site-built wooden arch and thereby reduce the amount of labor required on a job site to install windows and doors having an arched upper perimeter. Where load bearing capacity is required, the method of the present invention accounts for such needs. In addition to having a labor saving advantage, the method of the present invention also reduces construction site cost by eliminating the material waste associated with materials that are incorrectly measured and cut on a job site. Although it is known to have interconnecting structural panels each having a top load-carrying header plate to erect a load bearing wall, devices used to support a masonry arch during construction, and prefabricated concrete slabs which can be vertically positioned within an elongated ground trench and connected to form a building structure, as well as apparatus for molding prefabricated concrete sections on site for use in the construction of vaulted structures such as culverts and tunnels, it is not known to have a method and system for using monolithic pre-formed structures for the installation of arched windows and doors that has all of the advantages of the present invention.

SUMMARY OF INVENTION—OBJECTS AND ADVANTAGES

It is the primary object of this invention to provide a time saving method for installing arched windows and doors in residential and commercial construction. It is a further object of this invention to provide a cost reducing method for installing arched windows and doors in residential and commercial construction. It is also an object of this invention to provide a monolithic pre-formed header and arch opening in standard sizes that can be easily transported to a construction site and easily handled during installation into standard sizes of rectangularly framed window and door openings. A further object of this invention is to provide monolithic pre-formed header and arch openings for custom work involving non-standard sizes of windows and doors. It is also an object of this invention to provide a monolithic pre-formed header and arch opening that is made from plant pre-cast and reinforced concrete so as to be load bearing. It is a further object of this invention to provide monolithic pre-formed header and arch openings that are not load bearing. A further object of this invention is to provide pre-formed arched structures for wood frame construction that are not load bearing and made at least in part from recycled plastic.

As described herein, properly manufactured and used to install arched windows and doors within framed rectangular openings in block and wood frame structures, the method and system of the present invention would provide a means for more rapid and cost efficient on-site installation of the arched windows and doors than is currently possible with the commonly used method of site-built arches made from plywood and 2×4's. The present invention can be configured for installing standardize size arched windows and doors, as well as the nonstandard sizes needed for custom work. In block construction the present invention contemplates the use of a plant pre-cast and reinforced concrete monolithic header and arched opening combination for each arched window or doorway incorporated into a building design, which after manufacture is transported to a job site, set upon the exposed upper surfaces of blocks positioned on opposite sides of the wall opening to create the intended arched window or doorway configuration. and thereafter attached directly to the block adjacent to the upper portion of the window or doorway opening with mortar and/or mortar in combination with other attachment means. When attached in its usable position, the top of the monolithic header and arched opening combination is approximately level with the top of the wall opening. In setting each pre-cast monolithic header and arched opening combination upon the upper surface of blocks on both sides of a wall opening, a near seamless and uniformly concave upper perimeter is formed within the wall opening. Since the concrete header and arched opening combination is monolithic. it is load bearing and provides strong support for the wall structure above the window or doorway opening. and it can be readily and easily connected to adjacent block with mortar. In addition it is contemplated for the pre-cast concrete header and arched opening combinations to have a central upper groove extending longitudinally the entire length of its upper surface. at least one reinforced steel rod or bar positioned below the upper groove and extending longitudinally the entire length of the concrete header and arched opening combination, and at least one second groove positioned within the upper surface of the concrete header and arched opening combination which intersects with the longitudinal upper groove and is oriented approximately perpendicular thereto. Although not limited thereto, the most preferred embodiment would have two rods and one second groove. It is contemplated that mortar be placed within the longitudinal upper groove and each of the second grooves in the upper surface of the concrete header and arched opening combination to help provide an enhanced base structure for more secure support of the block to be placed directly above the combination. The portions of the reinforcing rods or bars extending beyond the ends of the header further help to stabilize the concrete header and arched opening combination in its usable position against block on the upper side walls of the window or doorway opening, as the rod extensions are inserted into receiving holes formed in the adjacent wall block and become secured therein with mortar.

In contrast, for wood frame construction the pre-formed header and arched opening combination can be made load-bearing or non-load-bearing. For non-load-bearing wood frame construction use, it is contemplated for one embodiment of the arch filler comprising the pre-formed header and arched opening combination to be made in the same configuration as the concrete embodiment with opposed downwardly depending appendages each set upon a piece of support framing during use. The top of such an embodiment can be set within the wall opening so that the top of the arch filler is approximately level with the top of the wall opening for attachment to an independent superimposed lintel. In the alternative, the top of such an embodiment can be set within the wall opening so that the top of the arch filler is substantially horizontal and slightly below the top of the wall opening for attachment to a piece of framing material, over which a load-bearing lintel would be secured. It is contemplated for all of the above-mentioned non-load-bearing wood frame construction embodiments to be made from lightweight, cost efficient materials, such as recycled plastic. Also, in non-load-bearing situations. molded embodiments of the present invention could be made to comprise a lintel and be thereby configured as a lightweight, one-piece arch filler and lintel unit. However, in wood frame construction where load-bearing capacity is required, a lintel and attached arch filler would be made at least in part from stronger materials. For wood frame installation of the header and arched opening combination contemplated by the present invention, a rectangular opening for a window or doorway would be created during routine construction of a building wall. Additional wood framing material could be added to the bottom portion of the window or doorway opening, if needed, to provide support for the lateral downwardly depending appendages of the arched opening part of the combination. The appendage support framing would have a length dimension that allowed any upwardly depending lintel to overlay and be supported by framing on both sides of the window or doorway opening. For example, if the curvature of the arched opening dictated appendages extending approximately one-third the vertical distance of the wall opening, support framing material for the appendages could be added to approximately the inside bottom two-thirds of the window or doorway opening to allow the top of the arch filler to be positioned approximately level with the top of the framing on both sides of the window or doorway opening. In the alternative, it is considered within the scope of the present invention for the downwardly depending appendages to be manufactured off-site so as to extend to the bottom of the intended window or doorway opening. While such an alternative would slightly reduce on-site construction time and might be favored in some custom construction work, reduced convenience in handling, transport, and storage would cause such an alternative to be disfavored for the installation of standard sizes of arched windows and doors. After transport to a construction site, wood frame construction embodiments of the present invention would then be placed into their usable positions and secured into place with fasteners, bonding agents, or differing combinations of both. It is also contemplated that the pre-formed header and arched opening embodiments for wood frame construction could have a central upper groove extending longitudinally the entire length of its upper surface. Reinforced steel rod positioned below the upper groove and extending longitudinally the entire length of the header and arched opening combination, would not generally be required for wood frame construction. It is contemplated that the longitudinal upper groove will help to more securely attach the combination to the upper wall structures adjacent to the opening and help to provide an enhanced base structure for more secure support of any wall placed directly above the header and arched opening combination.

The description herein provides preferred embodiments of the present invention but should not be construed as limiting its scope. For example, variations in the number of reinforced steel bars used, the positioning of the steel bars relative to the longitudinal upper groove, the dimension of the longitudinal upper groove, the use of a second groove, the use of additional grooves similar to the second groove which intersect the longitudinal upper groove and are approximately perpendicular to it, and the radius of curvature of the concave arcuate perimeter edge of the arched opening, other than those shown and described herein, may be incorporated into the present invention. Thus the scope of the present invention should be determined by the appended claims and their legal equivalents, rather than the examples given.

DETAILED DESCRIPTION OF PREFERRED EMBODIMENTS

Figure 1:
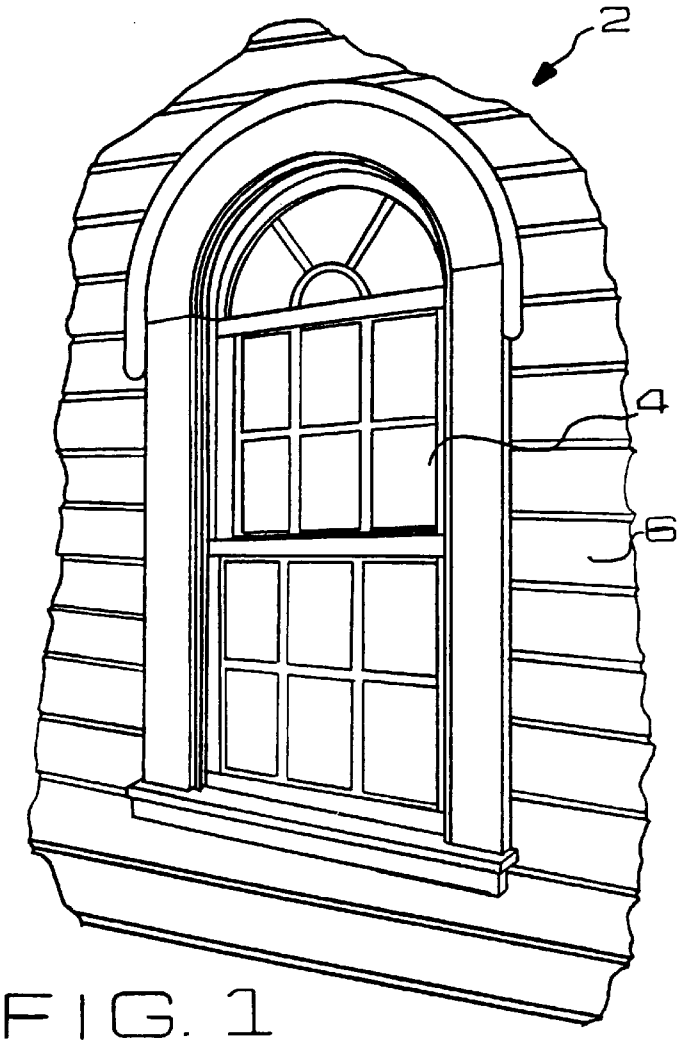
FIG. 1 is a perspective view of a typical arched window installed within a building wall.

The present invention discloses a method and system for use in forming arched openings in both concrete block and wood frame building construction for the installation of arched-type windows. such as the arched window 4 shown in FIG. 1. The materials from which the present invention was made would determine its load-bearing capacity. Although the discussion herein and the examples illustrated in FIGS. 1–7 relate to the installation of a standardize size and configuration of arched window with a convex upper perimeter, as illustrated in FIG. 1. applications could also include other uses. such as creation of arched doorways into which a framed door would be installed arched walkways into which no framed door would be installed, round or oval openings in a wall into which no framed window would be installed, lower arcuate surfaces in window openings for the installation of a framed window having a convex lower perimeter such as what might be expected for an elongated or round stained glass window, or the upper and lower convexly arcuate surfaces in window openings for the installation of a framed window having concave upper and lower perimeters such as what could be expected for an unusual artistic design in a stained glass window.

Figure 2:
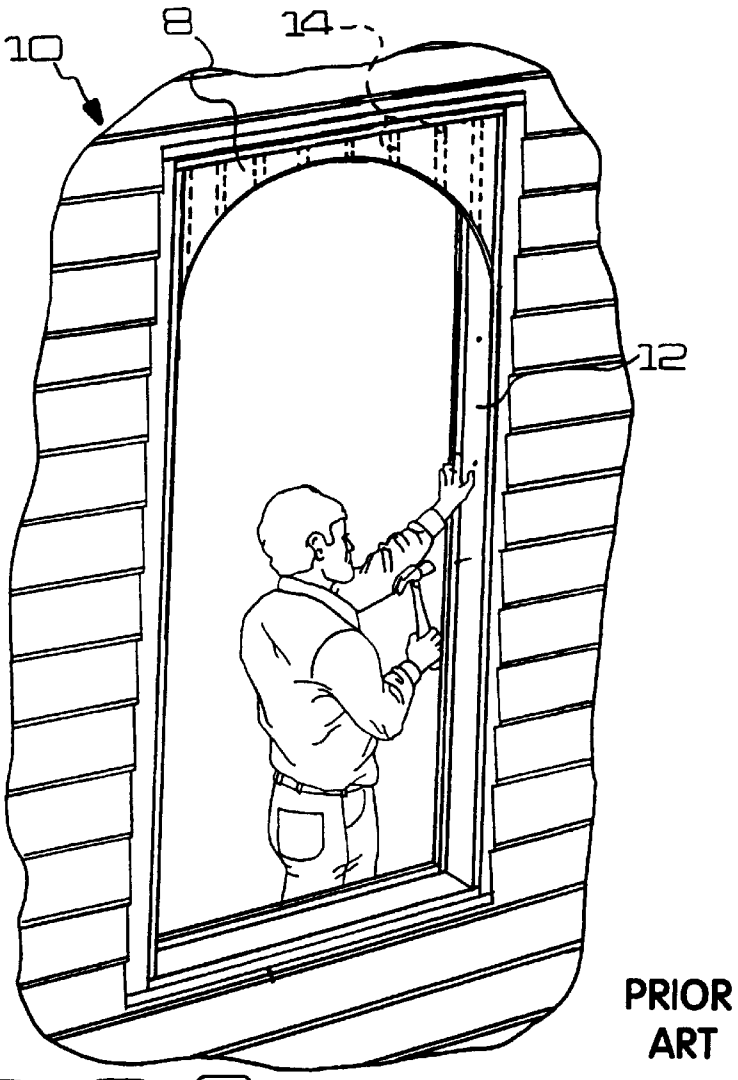
FIG. 2 is a perspective view of a prior art method for installing the type of arched window shown in FIG. 1 that involves a site-built arch constructed of 2×4 's and plywood.

FIG. 1 shows the system 2 of the present invention being used to attach an arched window 4 within an opening in a building wall 6. FIG. 2 shows a labor-intensive prior art system 10 for installing arched windows 4 through the use of site-built arches made from plywood 8 and structural two-by-fours 14. A wood frame 12 would first be installed around the window opening in a building wall. such as wall 6 in FIG. 1. Then the person making the site-built arch from plywood 8 and structural two-by-fours 14 would have to refer to the radius of curvature of the upper perimeter of arched window 4 and accordingly measure and cut several structural two-by-fours 14 having incremental differences in length. The shortest structural two-by-fours 14 would then be attached centrally to the upper perimeter of wood frame 12 so as to downwardly and perpendicularly depend therefrom. Thereafter, in succession the incrementally longer structural two-by-fours 14 would be placed at spaced-apart distances from the shortest structural two-by-fours 14 and also attached to wood frame 12 so as to also downwardly and perpendicularly depend therefrom. Referring again to the radius of curvature of arched window 4, two pieces of plywood 8 would be measured and cut each with one concavely arcuate perimeter edge having a radius of curvature identical to that of the upper perimeter of arched window 4. Plywood pieces 8 would then each be oriented with its arcuate perimeter edge facing the center of wood frame 12 and secured within the inside perimeter of wood frame 12 to each of the structural two-by-fours 14 attached to the upper perimeter of wood frame 12. Thereafter. the outer frame of arched window 4 would be attached to both wood frame 12 and plywood pieces 8 to securely install it within building wall 6. Thus, the prior art system was time consuming and cost inefficient.

Figure 3:
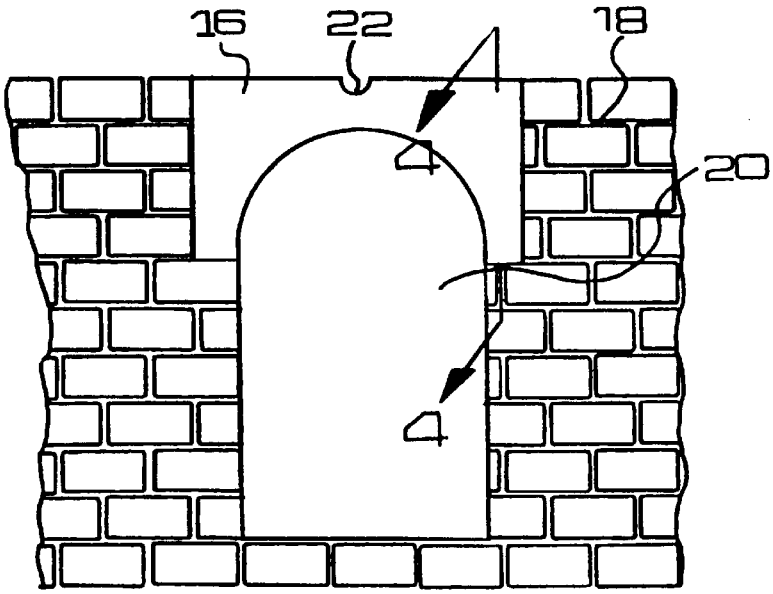
FIG. 3 is a front view of a first preferred embodiment of the present invention contemplated for block construction and having a monolithic plant pre-cast and reinforced concrete header and arched opening with a groove centrally located in its upper surface approximately perpendicular to its longitudinal axis, the lower lateral appendages on either side of the arched opening being supported upon the upper surface of wall block adjacent to the wall opening formed for the installation of an arched window. such as the arched type of window shown in FIG. 1.

FIG. 3 shows a first embodiment of the present invention for use in block construction and providing for the use of a monolithic arched plant pre-cast and reinforced concrete header and arch filler 6 for each arched window 4 incorporated into a building design. Each concrete header and arch filler 16 would be made off-site and thereafter transported to a construction job site for use. FIG. 3 shows concrete header and arch filler 16 positioned within a cinder block wall 18 to provide the definition of the upper perimeter of arched window opening 20. FIG. 3 also shows concrete header and arch filler 16 having a groove 22 centrally positioned within the upper surface of concrete header and arch filler 16 and oriented approximately perpendicular to the longitudinal axis of concrete header and arch filler 16. It is contemplated for mortar (not shown) to be placed within groove 22 to help provide an enhanced base structure for more secure support of the non-illustrated portion of cinder block wall 18 that would be placed directly above concrete header and arch filler 16. Although not shown and not critical to the present invention, it is contemplated in the present invention to have more than one groove 22 positioned in the upper surface of concrete header and arch filler 16 in an orientation approximately perpendicular to the longitudinal axis of concrete header and arch filler 16. As shown in FIG. 3, the lower lateral appendages of concrete header and arch filler 16 are set upon the upper surface of blocks on both sides of cinder block wall 18 so that the lower lateral appendages downwardly extend approximately one-third of the vertical height of arched window opening 20 and the upper surface of concrete header and arch filler 16 is approximately level with the upper surface of the top row of block in cinder block wall 18. The length dimension of the lateral downwardly extending appendages would be determined by the curved configuration of the window opening needed to complement the convex curvature the window, such as arched window 4, intended for installation therein, and would not always be limited to one-third of the vertical distance of the window or door opening. When concrete header and arch filler 16 is placed in its usable position with its upper surface approximately level with the upper surface of a row of block in cinder block wall 18, the upper configuration of arched window opening 20 becomes uniformly concave and seamlessly formed. The means of securing concrete header and arch filler 16 to cinder block wall 18 is not shown and is not critical, as long as concrete header and arch filler 16 becomes securely attached to cinder block wall 18 in a manner that allows concrete header and arch filler 16 to become a load-bearing part of cinder block wall 18. Typically, this would involve the use of mortar between the sides of concrete header and arch filler 16 and cinderblock wall 18, as well as between the top of concrete header and arch filler 16 and any portion of cinderblock wall 18 positioned above concrete header and arch filler 16. Reinforced rods or bars, such as reinforced steel rods 26 shown in FIG. 4, and fasteners (not shown) could also enhance the attachment between concrete header and arch filler 16 and cinderblock wall 18. The monolithic structure of concrete header and arch filler 16 provides strong support for any portion of cinder block wall 18 that might be constructed above arched window opening 20 and it allows for easy connection to adjacent portions of cinder block wall 18 through the use of mortar (not shown) or a combination of mortar and other appropriate attachment means.

Figure 4:
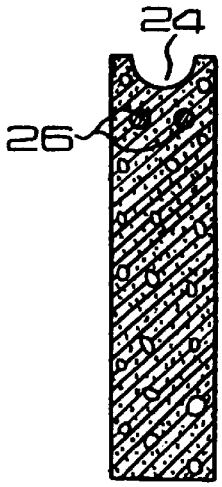
FIG. 4 is a side view of the first embodiment of the present invention taken along line 4—4 in FIG. 3 and showing a longitudinal groove extending the entire length of its upper surface, as well as two reinforced steel bars positioned longitudinally through the end of the first embodiment at a spaced-apart distance from one another beneath the longitudinal groove.

FIG. 4 shows a longitudinal groove 24 extending centrally through the entire length of the upper surface of concrete header and arch filler 16. FIG. 4 also shows two reinforced steel rods 26 positioned at a spaced-apart distance from one another below longitudinal groove 24 and extending through the end of concrete header and arch filler 16. Although not shown and not critical to the present invention, in the preferred embodiment it is contemplated for reinforced steel rods 26 to longitudinally extend through the entire length of concrete header and arch filler 16. Also, although two reinforced steel rods 26 are shown in FIG. 4, the use of two reinforced steel rods 26 is not critical to the present invention and it is contemplated to have more or less than two reinforced steel rods 26 extending longitudinally through concrete header and arch filler 16. The positioning of reinforced steel rods 26 relative to longitudinal groove 24 is also not critical, however, in the preferred embodiment it is contemplated for reinforced steel rods 26 to be approximately centered between the lower perimeter of grooves 22 and the upper perimeter of arched window opening 20. Further, although not shown in FIG. 4, it is contemplated for reinforced steel rods 26 to extend beyond both ends of concrete header and arch filler 16 for use in attachment of concrete header and arch filler 16 to adjacent portions of cinder block wall 18. Also, the dimension of longitudinal groove 24 is not critical to the present invention, however, longitudinal groove 24 should be of sufficient dimension to allow secure attachment of concrete header and arch filler 16 with mortar (not shown) to any structure placed above concrete header and arch filler 16. Although not shown, it is contemplated for one means of attachment of concrete header and arch Filler 16 to a structure placed above it would be through the placement of mortar within longitudinal groove 24, as well as in groove 22 shown in FIG. 3. Although the means for securing concrete header and arch filler 16 to cinder block wall 18 is not shown and although not limited to the following, in the preferred embodiment it is contemplated for concrete header and arch filler 16 to be secured to cinder block wall 18 through the use of mortar, fasteners, reinforced steel rods 26, and varying combinations thereof.

Figure 5:
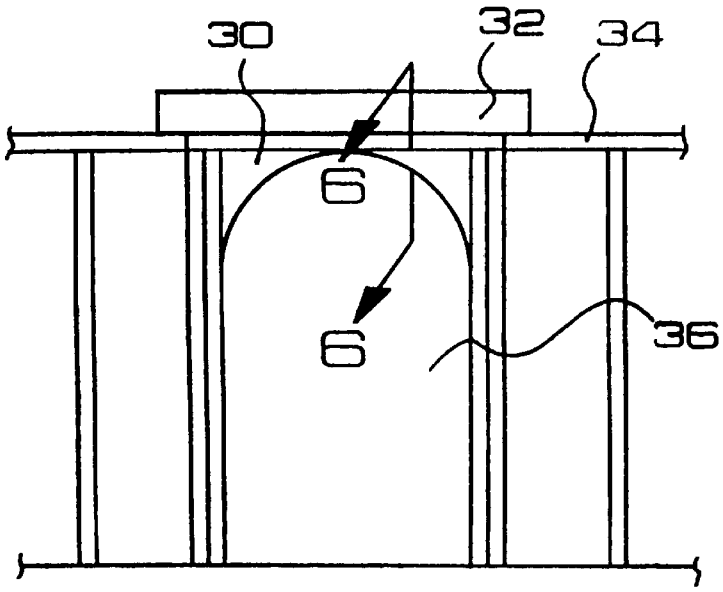
FIG. 5 is a front view of a second preferred embodiment of the present invention contemplated for wood frame construction and having an arched opening filler, the lower lateral appendages of the arched opening filler being arcuate and attached directly to framing adjacent to the window opening. a separate lintel overlaying the upper surface of the wall frame adjacent to the window opening for load bearing support.

FIG. 5 shows a second preferred embodiment of the present invention contemplated for use in wood frame construction and providing a pre-formed arch-filling member 30 downwardly depending from the upper portion of a wooden wall frame 34 and positioned between the upper sides of wall frame 34 within wall opening 36 for use in rapid and cost-efficient on-site installation of a window or door therein, such as arched window 4 shown in FIG. 1. FIG. 5 shows the lower lateral surfaces of an independent load-bearing lintel 32. centered above opening 36 and overlaying the upper surface of wooden wall frame 34. FIG. 5 also shows the lower lateral surfaces of pre-formed arch-filling member 30 being arcuate and attached directly to wall frame 34 without supplemental appendage support, such as that shown in FIG. 7 as being a part of wall frame 34. Although FIG. 5 shows pre-formed arch-filling member 30 extending approximately one-fourth of the vertical length of opening 36, the height dimension of pre-formed arch-filling member 30 would not be limited thereto and instead would vary according to the convex curvature of the window, such as arched window 4 in FIG. 1, intended for installation within opening 36. Also, although not shown and where load-bearing capacity is not required, it is contemplated that lintel 32 and pre-formed arch-filling member 30 could be made as a one-piece unit from molded construction, perhaps from recycled plastic. Where load-bearing capacity is required, lintel 32 and pre-formed arch-filling member 30 could be made as separate pieces from different materials and combined off-site to facilitate on-site installation. The method of construction and materials used for lintel 32 and pre-formed arch-filling member 30 would therefore not be critical and would depend upon the intended use. For installation of lintel 32 and pre-formed arch member 30 within wooden wall frame 34 for defining the upper perimeter of opening 36, wooden wall frame 34 would be constructed so as to have an essentially rectangular space therein. Such a space can be open-ended or closed, depending on whether lentil 32 and arch-filling member 30 are attached to one another off-site. Although not shown, it is contemplated for pre-formed arch-filling member 30 shown in FIG. 5 to be secured to wooden wall frame 34 through the use of fasteners, bonding agents, or a combination of both.

Figure 6:
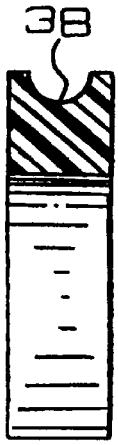
FIG. 6 is a side view of the second embodiment of the present invention taken along line 6—6 in FIG. 5 and showing a longitudinal groove extending the entire length of its upper surface.

FIG. 6 shows a longitudinal groove 38 that could extend centrally through the entire length of the upper surface of arch-filling member 30. Reinforcing rods or bars, such as steel rods 26 in FIG. 4, are not critical to the second embodiment of the present invention. Although not shown in FIG. 6, in the second preferred embodiment when both lintel 32 and pre-formed arch-filling member 30 can be made off-site as a one-piece unit through molded construction from plastic, each can be separately formed from different materials and assembled off-site for enhanced speed of on-site installation of an arched window or door, or pre-formed arch-filling member 30 can be formed off-site and made available as a one-piece or two-piece unit for rapid on-site installation. In addition to ease of on-site handling, the two-piece embodiment of pre-formed arch-filling member 30 would also allow more efficient transport and pre-use storage thereof. Further, the dimension of longitudinal groove 38 is not critical to the present invention, however, longitudinal groove 38 should be of sufficient dimension to allow secure attachment of pre-formed arch-filling member 30 to any structure placed above it. Although not shown, it is contemplated for one means of attachment of pre-formed arch-filling member 30 to any structure placed above it would be through the placement of a bonding agent or adhesive within longitudinal groove 38, in addition to securing pre-formed arch-filling member 30 to the structure and wall frame 34 with nails, screws, or other fasteners.

Figure 7:
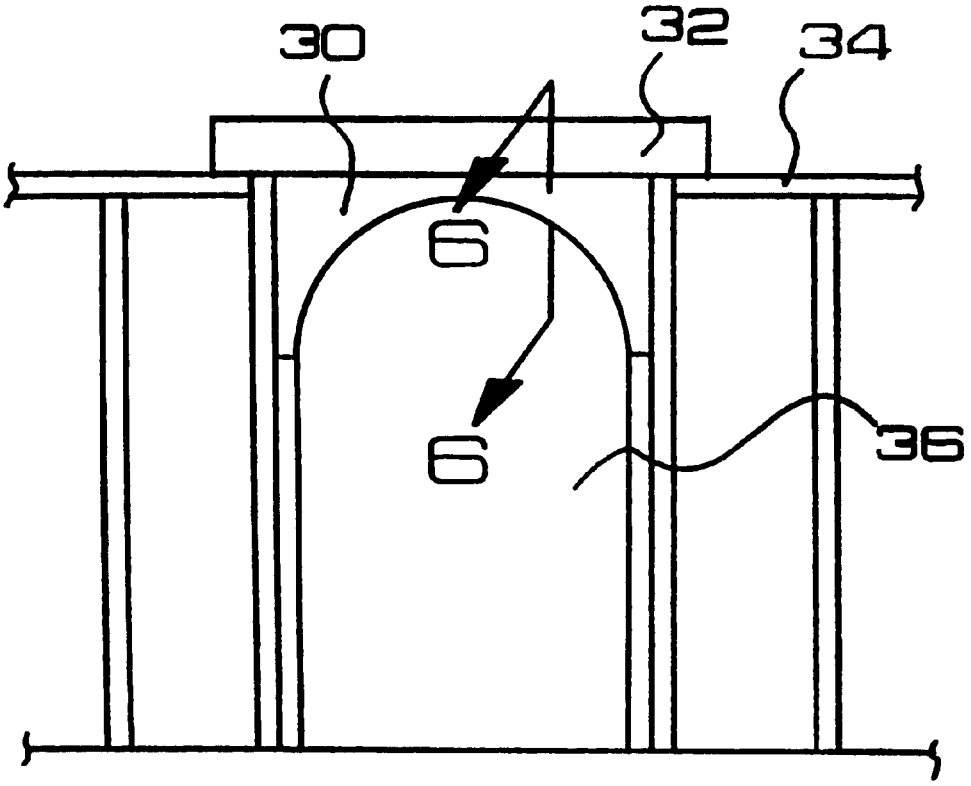
FIG. 7 is a front view of a third preferred embodiment of the present invention contemplated for wood frame construction and having a lintel and arched opening filler combination, the lower lateral appendages of the arched opening filler being supported upon the upper surface of wood framing pieces attached to approximately the lower two-thirds of the framed wall opening formed for the installation of an arched-type window, such as the arched-type window shown in FIG. 1. and the lintel overlaying the upper surface of the wall frame adjacent to the window opening.

FIG. 7 shows a third preferred embodiment of the present invention contemplated for use in wood frame construction and providing a lintel 32 with a pre-formed arch-filling member 30 downwardly depending from lintel 32. FIG. 7 shows the lower lateral surfaces of lintel 32 overlaying the upper surface of a wooden wall frame 34 defining approximately the lower two-thirds of an opening 36 in wooden wall frame 34 formed for the installation of an arched-type window, such as arched window 4 in FIG. 1. FIG. 7 also shows the lower lateral surfaces of pre-formed arch-filling member 30 resting on the upper surfaces of a portion of wooden wall frame 34 that extends upwardly along the sides of opening 36 approximately two-thirds of the vertical height of opening 36 so as to allow lintel 32 to rest upon the upper surfaces of wooden wall frame 34 lateral to opening 36. In the alternative, although not shown, pre-formed arch-filling member 30 could be made with sufficiently elongated lateral extensions that would rest upon the bottom inside surface of opening 36 and obviate the need for the additional supporting pieces of wooden wall frame 34 that are otherwise required. Although not shown in FIG. 7, it is contemplated for lintel 32 and pre-formed arch-filling member 30 to be made from molded construction as a one-piece unit, perhaps from recycled plastic. However, where load-bearing capacity is required, it is also contemplated for lintel 32 and pre-formed arch-filling member 30 to each be made as separate pieces from different materials. The method of construction and materials used for lintel 32 and pre-formed arch-filling member 30 would therefore not be critical and would depend upon the intended use. For installation of lintel 32 and pre-formed arch member within wooden wall frame 34 for defining the upper perimeter of opening 36, opening 36 would be constructed in wooden wall frame 34 so as to have an essentially rectangular configuration with an open upper end. If needed, additional wood framing material would be added to approximately the inside bottom two-thirds of opening 36 to provide support for the lateral downwardly depending appendages of pre-formed arch-filling member 30. The lintel 32 and pre-formed arch-filling member 30 combination would then be placed into its usable position so that lintel 32 overlays the upper surface of wooden wall frame 34, with lintel 32 and pre-formed arch-filling member 30 both being secured in the preferred embodiment to wooden wall frame 34 through the use of fasteners (not shown), bonding agents (not shown), or a combination of both. Although one-third and two-thirds measurements are illustrated in FIG. 7, it is considered within the scope of the present invention to include other height dimensions as determined by the curvature of the convex configuration of the window, such as arched window 4 shown in FIG. 1, intended for installation within opening 36.

Although not shown, it is contemplated for the radius of curvature of the downwardly oriented arcuate surfaces of arched window opening 20 shown in FIG. 6 and openings 36 shown in FIGS. 5 and 7 to vary. It is further contemplated for the surface texture of pre-formed arch-filling member 30 to be variable. In the preferred embodiment it is also contemplated for the approximate installation time of lintel 32 and pre-formed arch-filling member 30 within wooden wall frame 34 to take no more than five minutes. In addition, in the preferred embodiments it is contemplated for the thickness dimensions of concrete header and arch filler 16, as well as lintel 32 and pre-formed arch-filling member 30, to correspond to the thickness dimensions of cinder block wall 18 and wall frame 34 built according to code and with commonly available building materials typically used in residential and commercial building construction.

The invention I claim is:

1. A time-saving and cost-efficient monolithic system that is manufactured off-site and transported to a construction site for rapid and uniform on-site creation of arched openings in residential and commercial block walls, such as the openings used for the installation of arched windows and doors and which allows installation of arched windows and doors into an existing substantially rectangular wall aperture during a maximum time period of approximately five minutes, said system comprising:

a monolithic pre-formed arched opening unit, said unit having a thickness substantially similar to that of the wall into which it is intended for said unit to be placed, said unit also having opposed first and second surfaces with said first surface having a longitudinal groove, said second surface having a concave arcuate configuration, said monolithic pre-formed arched opening unit further comprising an arch filler between said first and second surfaces, said arch filler having a central arcuate member and opposed lateral appendages downwardly depending from said central arcuate member, the length dimension of said downwardly depending lateral appendages varying in proportion to the curvature of said central arcuate member;

attachment means for securely connecting said pre-formed arched opening unit to the structure surrounding the wall aperture into which it is intended for said unit to be placed; and wherein said unit comprises pre-cast concrete so as to be a load-bearing part of block construction, and wherein said attachment means comprises mortar positioned between said unit and opposite sides of the wall aperture into which it is intended for said unit to be placed, as well as between said first surface of said unit and any portion of a structure placed over said unit.

2. The system of claim 1 further comprising at least one additional groove in said first surface, each of said additional grooves being substantially perpendicular to said longitudinal groove and extending the entire width of said first surface.

3. The system of claim 1 wherein said unit further comprises at least one strengthening rod centered in vertical distance between said longitudinal groove and said concave second surface.

4. The system of claim 3 wherein said arch filler has opposing ends and each of said strengthening rods extends beyond said opposing ends of said arch filler for insertion within the opposite sides of the wall aperture into which it is intended for said unit to be placed.

5. The system of claim 4 wherein each of said strengthening rods is made from reinforced steel.

6. The system of claim 1 wherein said longitudinal groove within said first surface extends the entire length of said first surface.

7. The system of claim 1 further comprising at least one strengthening rod, and also further comprising at least one additional groove in said first surface, each said additional groove being substantially perpendicular to said longitudinal groove and extending the entire width of said first surface.

8. The system of claim 7 wherein said arch filler has opposing ends and at least one of said strengthening rods longitudinally extends beyond said opposing ends for insertion within the opposite sides of the wall aperture into which it is intended for said unit to be placed.

9. The system of claim 7 wherein at least one of said strengthening rods is made from reinforced steel.

10. The system of claim 1 further comprising at least one strengthening rod and wherein said arch filler has as opposing ends and each said strengthening rod longitudinally extends beyond said opposing ends for insertion within the opposite sides of the wall aperture into which it is intended for said unit to be placed.

11. The system of claim 1 wherein said attachment means further comprises means of attachment selected from a group consisting of fasteners, nails, screws, strengthening rods, strengthening bars, and reinforced steel rods.

12. The system of claim 1 wherein each of said lateral appendages has a distal end and further comprising a plurality of appendage supports each positioned below one of said lateral appendages so that said distal ends are all in contact with at least one of said appendage supports, and wherein said provided appendage supports each comprise a small ledge formed in adjacent wall block surrounding the wall aperture and have a height dimension complementing the vertical height of the one of said lateral appendages paired therewith so that the combined height dimension of each of said paired lateral appendages and appendage supports is approximately equivalent to the vertical height of the wall aperture used.

13. The system of claim 1 wherein said longitudinal groove is centrally positioned within said first surface.

14. A method for rapid and cost-efficient creation of uniform arched openings in residential and commercial block walls, such as the openings used for the installation of arched windows and doors, said method comprising the steps of:

providing a monolithic pre-formed arched opening unit comprising pre-cast concrete for each existing wall aperture, said units each having with a thickness substantially similar to that of the wall aperture into which it is intended for said unit to be placed, a first surface with a longitudinal groove therein, a concavely arcuate second surface, and an arch filler between said first and second surfaces, said arch filler having opposed lateral appendages downwardly depending from a central arcuate member and opposed side edges, also providing attachment means comprising mortar for connecting each of said units to the structure surrounding the wall aperture into which it is intended for said unit to be placed;

placing a first of said units within one of the wall apertures so that said first surface of said first unit is positioned above said second surface of said first unit, and said first surface of said first unit is substantially horizontal;

moving said arch filler of said first unit toward the top of the wall aperture until said first surface of said first unit contacts a support structure adjacent to the wall aperture to which said first unit can be secured during use;

using said attachment means to secure said opposed side edges of said arch filler of said first unit to the upper portion of the structure surrounding the wall aperture;

using said attachment means to bond said first surface and said longitudinal groove of said first unit to the support structure above the wall aperture; and repeating said steps of placing, moving, using said attachment means to secure the opposed side edges of said arch filler, and using said attachment means to bond said first surface and said longitudinal groove so as to secure each successive one of said units into a different one of the existing wall apertures and provide a means for installing arched windows and doors into substantially rectangular wall apertures each within a maximum time period of approximately five minutes.

15. The method of claim 14 further comprising the steps of providing a plurality of appendage supports and positioning each said appendage support below one of said lateral appendages so that the distal ends of all of said lateral appendages are in contact with at least one of said appendage supports, and wherein said provided appendage supports [are selected from a group consisting of] comprise a small ledge formed in adjacent wall block surrounding the wall aperture having a height dimension complementing the vertical height of the one of said lateral appendages paired therewith so that the combined height dimension of each of said paired lateral appendages and appendage supports is approximately equivalent to the vertical height of the wall aperture used.

16. The method of claim 14 further comprising a step of providing attachment means selected from a group consisting of fasteners, nails, screws, strengthening rods, strengthening bars, and reinforced steel rods.

17. The method of claim 14 wherein said longitudinal grooves in said first surfaces of said monolithic pre-formed arched opening units arc centrally positioned and extend the entire length of said first surface.

18. The method of claim 14 wherein said monolithic pre-formed arched opening units each further comprises at least one strengthening rod.

19. The method of claim 14 wherein said step of providing said pre-formed units consists of the providing of units having at least one additional upper groove in said upper surface, said additional upper grooves each being substantially perpendicular to said longitudinal upper groove, and further comprising a step of using said attachment means to bond each of said additional upper grooves of each of said units to the overhead portion of the structure surrounding the wall aperture into which said unit is placed positioned.

20. The method of claim 14 wherein said step of providing said pre-formed units consists of the providing of prestressed concrete units having at least one longitudinal strengthening rod centered in vertical distance between said longitudinal upper groove and said second surface, and further comprising a step of using said attachment means to secure the ends of each of said rods into the structure surrounding the wall aperture.

* * * * *

UNITED STATES PATENT AND TRADEMARK OFFICE

CERTIFICATE OF CORRECTION

PATENT NO. : 6,401,405 B1
DATED : June 11, 2002
INVENTOR(S) : C. Lorin Hicks

It is certified that error appears in the above-identified patent and that said Letters Patent is hereby corrected as shown below:

Column 3,
Line 11, after the word "monolithic" delete the period used for punctuation and replace with a comma.

Column 5,
Line 52, after the word "Fig. 1" delete the period used for punctuation and replace with a comma.
Line 54, between the words "installed" and "arched walkways" insert a comma as punctuation.

Column 8,
Line 55, delete the words "or two piece".
Lines 56-59, delete the entire sentence: "In addition to ease of on-site handling, the two-piece embodiment of pre-formed arch-filling member 30 would also allow more efficient transport and pre-use storage thereof."

Column 12,
Line 20, at the beginning of the line delete "[are selected from a group consisting of]".

Signed and Sealed this

Fourth Day of February, 2003

JAMES E. ROGAN
*Director of the United States Patent and Trademark Office*